United States Patent [19]

Tanabe

[11] Patent Number: 4,481,394

[45] Date of Patent: Nov. 6, 1984

[54] COMBINED MICROWAVE OVEN AND GRILL OVEN WITH AUTOMATED COOKING PERFORMANCE

[75] Inventor: Takeshi Tanabe, Higashiosaka, Japan

[73] Assignee: Sharp Kabushiki Kaisha, Osaka, Japan

[21] Appl. No.: 398,548

[22] Filed: Jul. 15, 1982

[30] Foreign Application Priority Data

| | | | |
|---|---|---|---|
| Jul. 21, 1981 | [JP] | Japan | 56-114671 |
| Jul. 27, 1981 | [JP] | Japan | 56-117278 |
| Nov. 11, 1981 | [JP] | Japan | 56-181662 |

[51] Int. Cl.[3] ..... H05B 6/68

[52] U.S. Cl. ..... 219/10.55 B; 219/10.55 R; 99/DIG. 14

[58] Field of Search ..... 219/10.55 B, 10.55 M, 219/10.55 R, 10.55 E; 99/325, 451, DIG. 14; 426/243, 523

[56] References Cited

U.S. PATENT DOCUMENTS

| | | | |
|---|---|---|---|
| 3,569,656 | 3/1971 | White et al. | 219/10.55 B |
| 4,097,707 | 6/1978 | Kobayashi et al. | 219/10.55 B |
| 4,162,381 | 7/1979 | Buck | 219/10.55 B |
| 4,317,977 | 3/1982 | Buck | 219/10.55 B |
| 4,350,860 | 9/1982 | Ueda | 219/10.55 B |
| 4,357,513 | 11/1982 | Kawata et al. | 219/10.55 B |
| 4,376,131 | 3/1983 | Mori et al. | 219/10.55 M X |
| 4,379,964 | 4/1983 | Kanazawa et al. | 219/10.55 B |
| 4,383,158 | 5/1983 | Niwa | 219/10.55 B |

*Primary Examiner*—P. H. Leung

*Attorney, Agent, or Firm*—Birch, Stewart, Kolasch & Birch

[57] ABSTRACT

A microwave oven is provided with a gas sensor and a heat-sensitive element (i.e. thermistor) within a passageway for outgoing air from the heating chamber. A microcomputer generates a heating stop instruction for a microwave source in response to output signals from the heat-sensitive element and the gas sensor and also in accordance with a stored program in the microcomputer. Based upon the variations with time in the output signal from the gas sensor, the microcomputer decides what kind of foodstuff is being heated and establishes a final level for the gas sensor at the end of microwave heating and a final level for the heat-sensitive element at the end of grill heating. A heating end instruction is issued when both the gas sensor and the heat-sensitive element reach their intended final levels. Furthermore, a compensation value (U) is selected based on the rate of variations in the output from the heat-sensitive element. After the microwave heating has been completed, grill heating is performed for a length of time which is determined by the compensation value (U).

3 Claims, 9 Drawing Figures

GAS SENSOR TERMINAL VOLTAGE
VH
VD1
VD2
VDS
VHS
VS1
VS2
VSS
CHINA BOWL
PREHEATED MATERIAL
HOT "SAKE"
T1
T2
START
TIME

THERMISTOR TERMINAL VOLTAGE
W=600g
400g
200g
100g
MICROWAVE HEATING TIME
T1
T2
CT2
CT1

THERMISTOR TERMINAL VOLTAGE
90V
100V
110V
MICROWAVE HEATING TIME

COMBINED MICROWAVE OVEN AND GRILL OVEN WITH AUTOMATED COOKING PERFORMANCE

BACKGROUND OF THE INVENTION

This invention relates to a microwave oven and especially it relates to a combined microwave oven and grill oven which determines from a time-dependent variance in a terminal voltage at a gas sensor, what kind of food is being cooked and then determines automatically when cooking of food is to be completed.

The conventional types of automatic microwave ovens capable of automatically controlling the progress of food cooking with the aid of a sensor or sensors are provided with a predetermined number of keys each for a different kind of food by which different final cooking temperatures are preset.

The present invention improves upon such microwave ovens by providing means which determine what kind of food is being heated and determines and senses its optimum final cooking temperature, based upon a time-dependent variance in a terminal voltage at a gas sensor. This eliminates the need for individual presetting keys for the different kinds of food for automated cooking processes, as fully disclosed in coopending application Ser. No. 393,611 filed June 30, 1982. However, the copending application is not concerned with a combined microwave oven and grill heater oven.

OBJECT AND SUMMARY OF THE INVENTION

Accordingly, it is an object of the present invention to provide an automatic microwave oven and grill heater oven with means which assures automation of comined microwave and grill heating.

In carrying out this object, the present invention provides a combined microwave oven and grill heater oven which comprises a heating chamber in which foodstuff is heated, two sensors for sensing properties of the atmosphere wherein heating is effected in the heating chamber of the combined oven and for providing voltages indicative of variations in the properties, means for determining, from timewise variations in the voltage derived from one of the two sensors, what kind of foodstuff is being heated and if the microwave heating of the foodstuff is completed, means for governing the microwave heating in the heating chamber in response to the output of the determining means, and means for governing the grill in response to the output from the other of the two sensors.

In a preferred form of the present invention, there are provided two sensors, typically, a gas sensor and a heat-sensitive element (i.e. thermistor) within a passageway for outgoing air from the heating chamber. A switching means for controlling an enabling circuit for a microwave source such as a magnetron is provided and a cook switch is provided which is common to all of the different kinds of foodstuff to be heated. A microcomputer is provided which generates a heating stop instruction for the enabling circuit for the microwave source in response to not only output signals from the heat-sensitive element and the gas sensor but also by a stored program in the microcomputer. Based upon the rate of variations in the output signal from the gas sensor, the microcomputer decides what kind of foodstuff is being heated and then establishes an intended final level which the gas sensor shall reach at the end of heating and an intended final level which the heat-sensitive element shall reach at the end of heating. A heating end instruction is issued when both the gas sensor and the heat-sensitive element reach their intended final levels. Furthermore, a compensation value (U) is evaluated from the rate of variations in the output from the heat-sensitive element. After the microwave heating has been completed, grill heating is performed for a length of time which is determined by the compensation value (U).

BRIEF DESCRIPTION OF THE DRAWINGS

The present invention will be better understood from the detailed description given hereinbelow and the accompanying drawings which are given by way of illustration only, and thus are not limitative of the present invention and wherein.

DETAILED DESCRIPTION OF THE INVENTION

Figure 1:
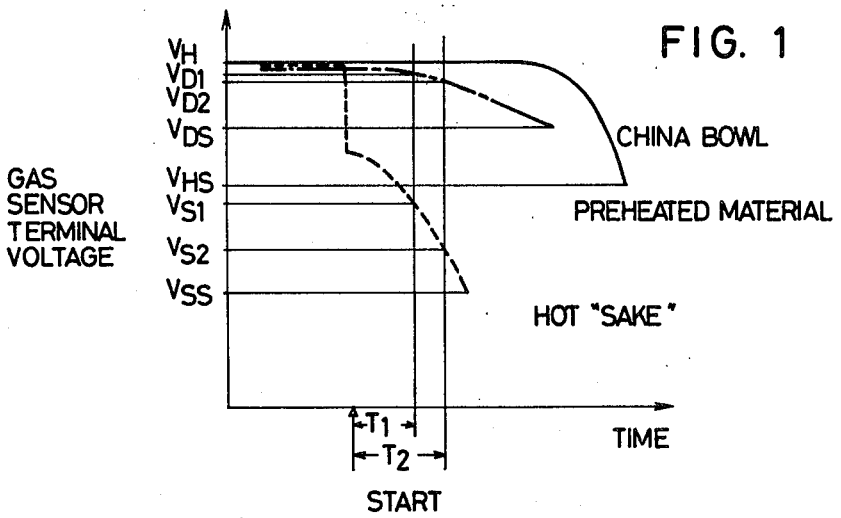
FIG. 1 is a graph for explaining the principle of food kind determination in accordance with the present invention.

To give a better understanding of the present invention, the operating principle of automation of cooking processes will be discussed first. FIG. 1 illustrates variances of a terminal voltage $V_G$ at a gas sensor 7 with time, based upon the kind of food. If a ratio of $V_{T2}$ to $V_{T1}$ is evaluated where $V_{T1}$ is the terminal voltage at the sensor when a time $T_1$ has expired after the beginning of heating and $V_{T2}$ is the volage when a time $T_2$ has expired, such ratio will be significantly different depending upon the kind of food. Assuming that $T_1=30$ sec and $T_2=40$ sec, the ratio is less than 0.9 for hot "sake", 0.9 to 0.95 for prepared side dishes and rice bowls and 0.95 to 1.0 for prepared materials enclosed with a wrapping film. The kind of food is therefore determined from the ratio $V_{T2}/V_{T1}$ and its optimum levels $V_{HS}$, $V_{DS}$ and $V_{SS}$ of $V_G$ is then selected for interruption of. However, if the detection levels $V_{HS}$, $V_{DS}$ and $V_{SS}$ for deciding the kind of food and interrupting heating are dependent only upon the terminal voltage $V_G$ from the gas sensor, heating may be insufficient for food of a greater weight since heat energy necessary for heating varies with the weight of food. Best cooking conditions may not be available for a wide range of the weight of food.

Figure 2:
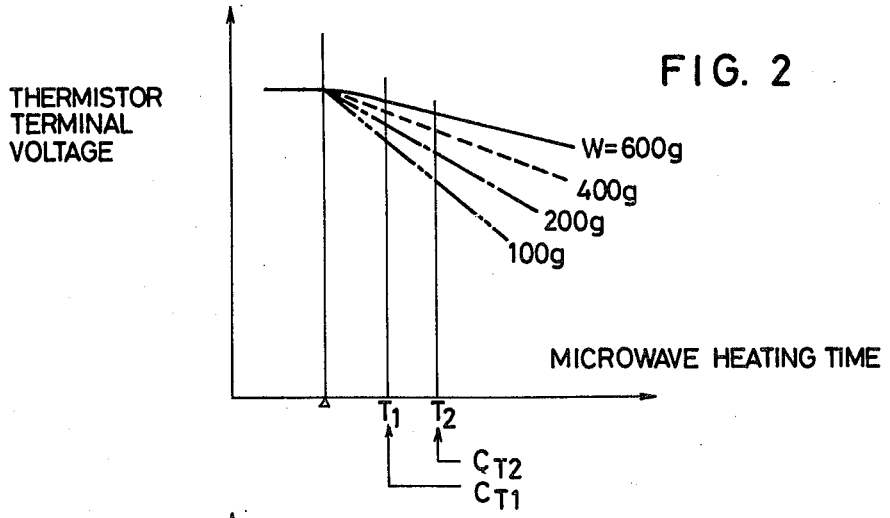
FIGS. 2 and 3 are graphs for explaining ways to solve prior problems by the present invention.

FIG. 2 shows how a terminal voltage $V_T$ at a thermistor varies with the passage of heating time, depending upon different weights of food, for example, 100 g, 200 g, 400 g and 600 g. Especially, this graphic representation also indicates that the terminal voltage $V_T$ falls substantially in a linear fashion with an increase in exhaust air with the passage of time regardless of the kind of food or whether food is enclosed with a wrapping film.

The length of grill heating by a heater or heaters, on the other hand, is determined primarily by the kind of food and not the weight of food. Typically, the length of heating is 8 min for grilled mackerel and 12 min for gratin. However, it is also obvious that the heating time should differ when the weight of food is greatly different such as between one cut of mackerel and six cuts. Furthermore, the results of grill heating is substantially affected when a power voltage fluctuates up and down.

Figure 3:
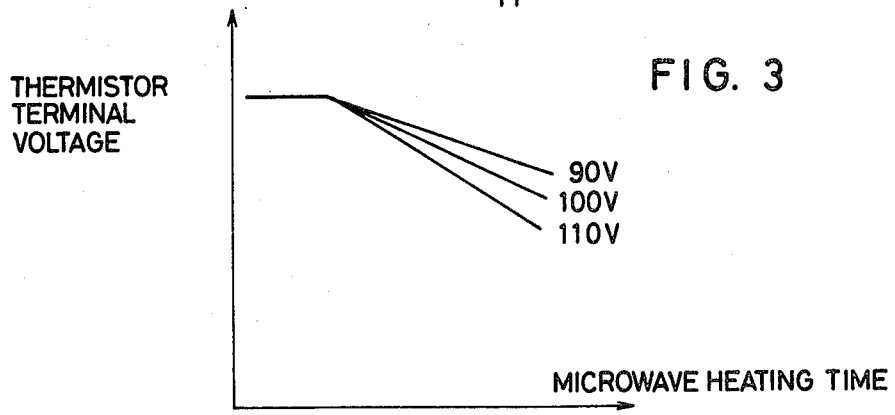
Figure 4:
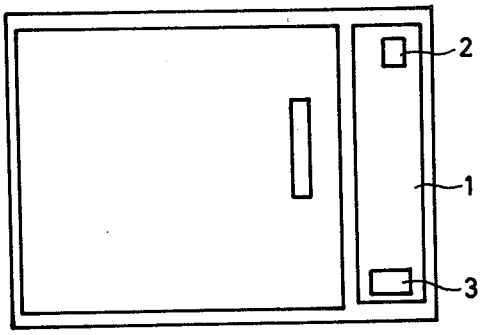
FIG. 4 is a front view of a combined oven according to an embodiment of the present invention.
Figure 5:
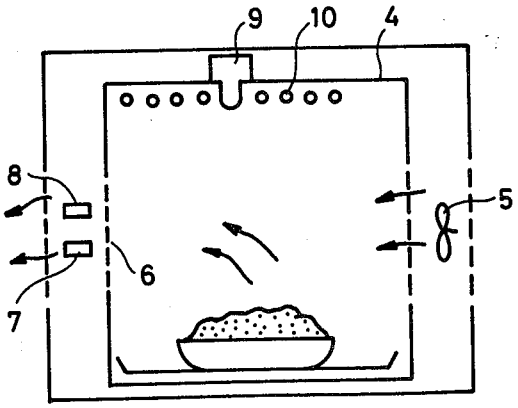
FIG. 5 is an elevational cross sectional view of the combined oven as shown in FIG. 4.

FIG. 3 shows variances in the thermistor voltage $V_T$ when the weight of food to be heated is fixed but the power voltage varies. A gas sensor 7 and a thermistor 8 are disposed in an air outlet 6 at a high temperature. The gas sensor 7 demonstrates a variance in resistance as a function of the condensation of exhaust gas from food, whereas the thermistor 8 shows a variance in resistance as a function of the temperature of the exhaust gas rising with the progress of heating. As is well known in the art, there are provided a magnetron 9 for radiating microwaves and an infrared heater 10 for performing grilling of food.

Figure 6:
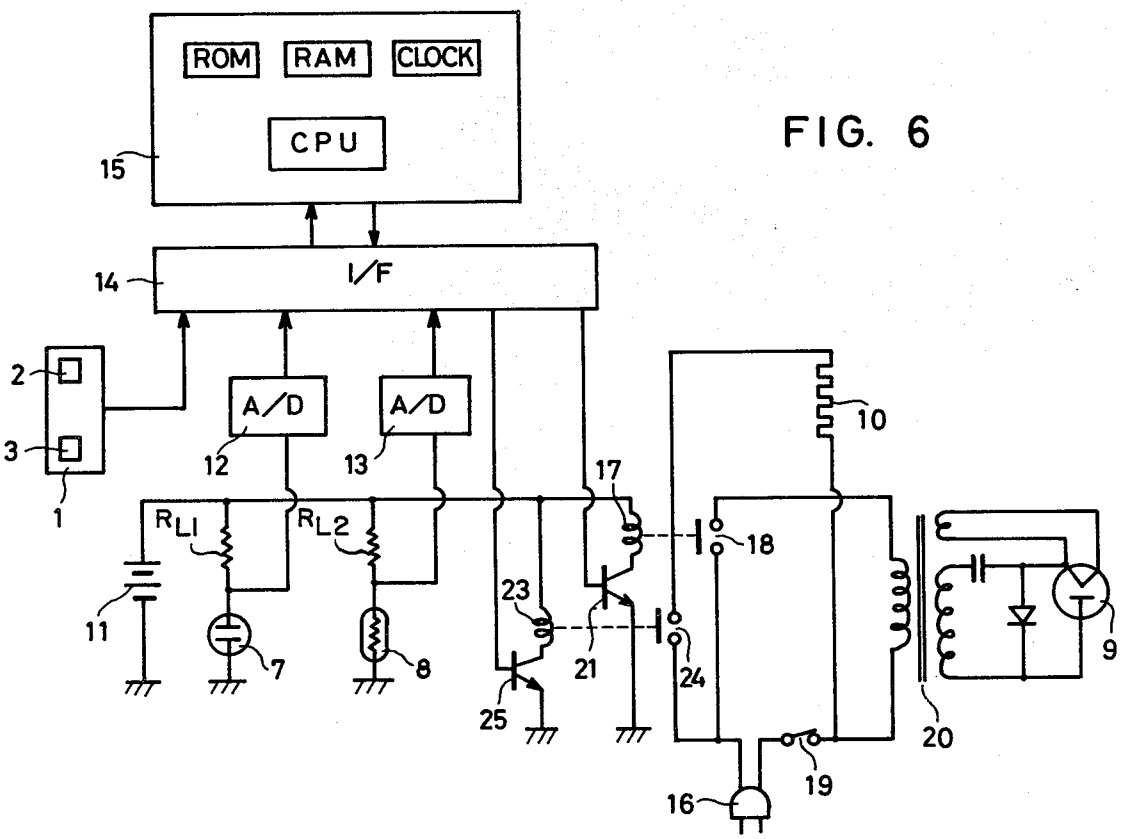
FIG. 6 is a circuit diagram of the combined oven.

FIG. 6 is a circuit diagram of a combined microwave oven and grill oven according to an embodiment of the present invention. The gas sensor 7 is connected via a load resistor $R_{L1}$ and the thermistor 8 is connected via a load resistor $R_{L2}$ to a DC power source 11. The terminal voltage $V_G$ of the gas sensor 7 and the counterpart $V_T$ of the thermistor 8 are respectively supplied to a central processing unit CPU in a microcomputer 15 via analog-to-digital converters 12 and 13 and an input/output interface 14. The microcomputer 15 includes a ROM containing programs or the like, a RAM and a clock generator in addition to the CPU. The contents of the programs will be discussed later with regard to FIG. 9. Key signals on an operational panel 1 also are supplied to the microcomputer 15 via the interface 14. The magnetron 9 is enabled with a utility AC power source 16 by way of a contact 18 of a microwave exciting relay 17, a door switch 19, a booster transformer 20, etc. The grill heater 10 is energized with the utility AC power source 16 by way of a contact 24 of a heater exciting relay 23 and the door switch 19. Both the microwave exciting relay 17 and the heater exciting relay 23 are switched by the interface 14 and transistors 21 and 25 responsive to instructions from the CPU.

Figure 8:
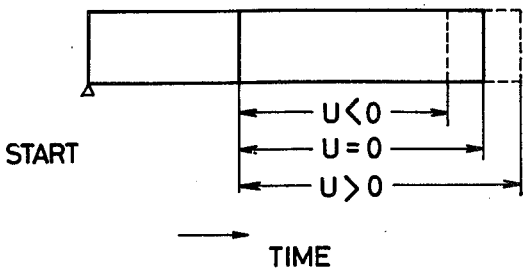
Figure 9:
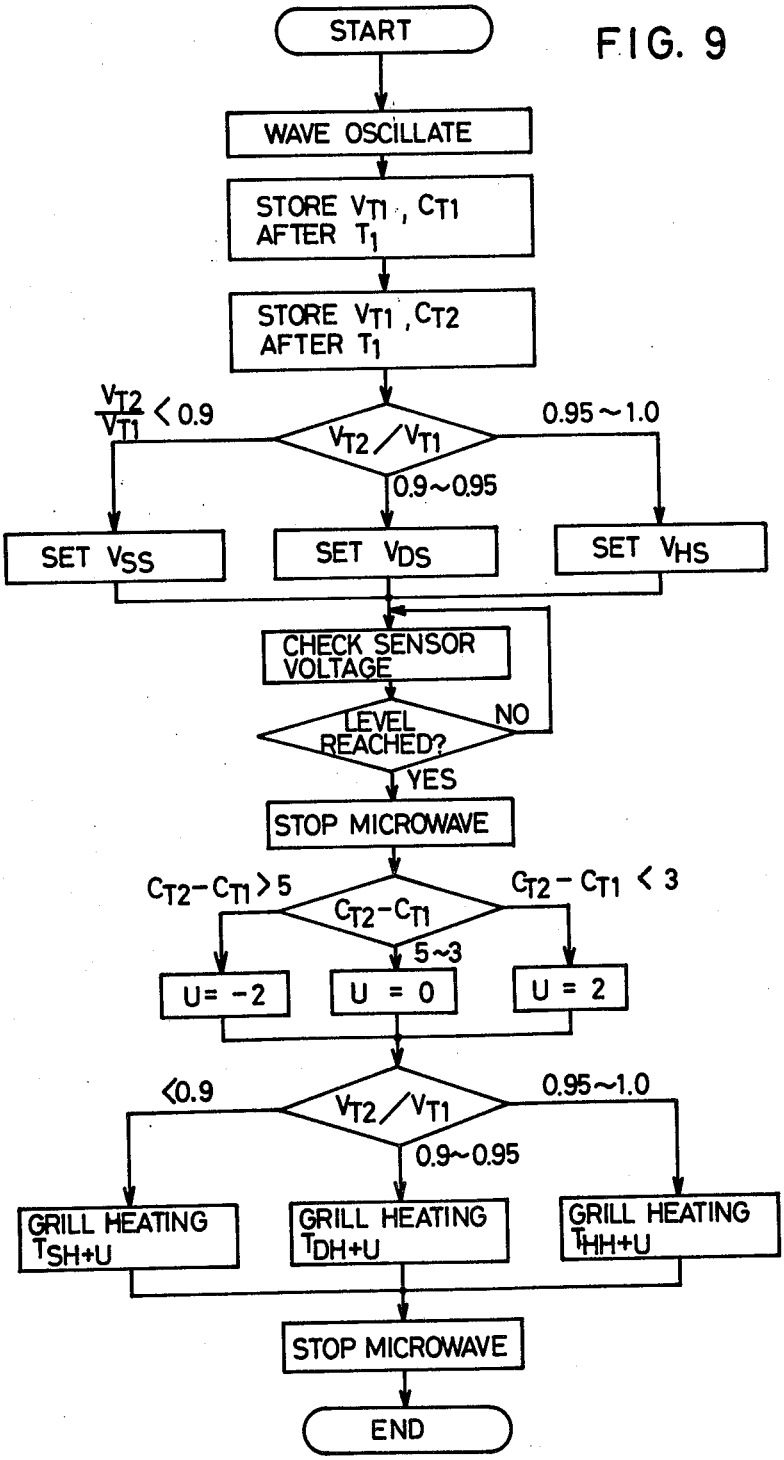
FIG. 9 is a flow chart for explaining operation of the combined oven.

Operation of the above illustrated combined oven will be made clear from a graph of FIG. 7, a time chart of FIG. 8 and a program flow chart of FIG. 9.

When an "auto" cooking key 2 is pressed and a heating key 3 is depressed, such keyed signals are fed to the CPU which in turn energizes the microwave exciting relay 17 to permit the magnetron 9 to oscillate and start microwave heating. The terminal voltage $V_{T1}$ of the gas sensor after time $T_1$ has gone by is loaded into the RAM. Furthermore, the terminal voltage $V_{T2}$ of the gas sensor when time $T_2$ has gone by after the beginning of heating is loaded into the RAM. The CPU calculates the ratio $V_{T2}/V_{T1}$ and then determines from such ratio $V_{T2}/V_{T1}$ what kind of food is in the process of being heated. Eventually, the CPU selects one of the optimum levels $V_{HS}$, $V_{DS}$ or $V_{SS}$.

In a likewise manner as the terminal voltages $V_{T1}$ and $V_{T2}$, the terminal voltage $V_T$ of the thermistor is measured after the times $T_1$ and $T_2$ have expired and the results of such measurments $C_{T1}$ and $C_{T2}$ are loaded into the RAM. The difference $(C_{T2}-C_{T1})$ is smaller than 3 for 450 g of weight W of food and larger than 5 for 150 g of food. The CPU can conclude that about 150 g or less food is being heated when $C_{T2}-C_{T1}>5$, about 150 to 400 g of food is being heated when the difference is 5 to 3 and more than about 400 g of food is in the oven when the same is less than 3. It should be noticed that the terminal voltages $C_{T1}$ and $C_{T2}$ of the thermistor are representations of the temperature (°C.) of the exhaust gas.

Figure 7:
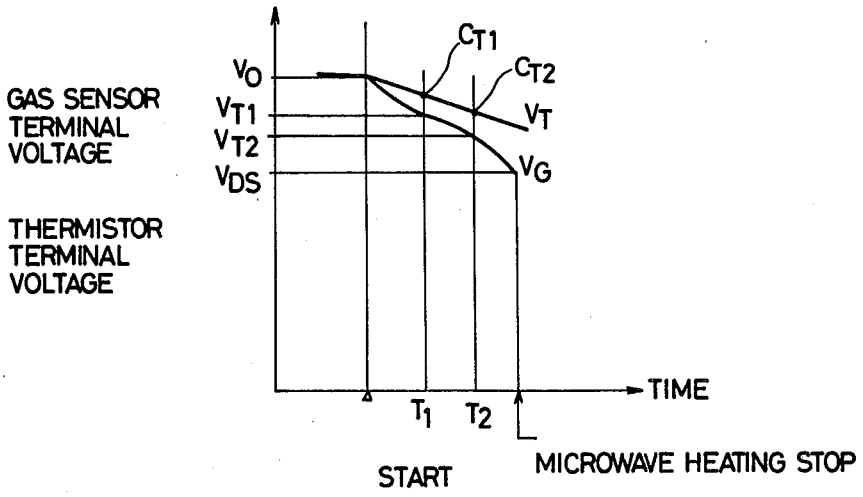
FIGS. 7 and 8 are characteristic charts for explaining operation of the above combined oven.

FIG. 7 depicts the histories of the terminal voltage $V_G$ of the gas sensor and the terminal voltage $V_T$ of the thermistor from the beginning to end of microwave heating.

When the ratio $V_{T2}/V_{T1}$ is in a range of 0.95 to 1.0, the level $V_{DS}$ is selected for ending microwave heating and a compensation value U is selected for determining the time of grill heating based on the differential terminal voltage $(C_{T2}-C_{T1})$ of the thermistor. Typically, if $C_{T2}-C_{T1}<3$, then U=plus(+)2 min. If $C_{T2}-C_{T1}$ is between 5 and 3 then U=0 and if $C_{T2}-C_{T1}>5$ then U=minus(−)2 min. It is clear to those skilled in the art that the ratio $C_{T2}/C_{T1}$ may be used or thermistor voltages may be directly calculated instead of the difference $(C_{T2}-C_{T1})$.

As noted eariler, what kind of food is in the process of being heated is determined by the rate of the variances in the terminal voltage $V_G$ of the gas sensor and microwave heating is continued until the optimum level $V_{HS}$, $V_{DS}$ or $V_{SS}$ is reached. Once the optimum level or final cooking temperature has been reached, an end instruction is issued for microwave heating procedure.

Based upon the ratio $V_{T2}/V_{T1}$ or other factors, a normal length of grill heating time $T_{SH}$, $T_{DH}$ or $T_{HH}$ is selected and the grill heater 22 is enabled for such selected time plus or minus the compensation value U. The time of grill heating is controlled by a counter in the CPU or a timer external to the CPU.

It is further possible to close off ventilation in the heating chamber for a given time after grill heating has been completed, so that residual heat from the heater can be used to further heat food. Thereafter, the ventilation is opened to ventilate the internal atmosphere of the heating chamber.

Whereas the present invention has been described with respect to specific embodiments thereof, it will be understood that various changes and modifications will be suggested to one skilled in the art, and it is intended to encompass such changes and modifications as fall within the scope of the appended claims.

What is claimed is:

1. A combined microwave oven and grill oven comprising:

a heating chamber in which foodstuff is heated;

a microwave source and grill means for heating foodstuff in said chamber;

a first sensor for detecting a first characteristic of the atmosphere in said chamber and for providing a first output voltage indicative of said first characteristic;

a second sensor for detecting a second characteristic of the atmosphere in said chamber and for providing a second output voltage indicative of said second characteristic;

means for determining from variations in said first output voltage the kind of foodstuff being heated in said chamber and for controlling completion of microwave heating in response to said first output voltage; and means for controlling heating of said foodstuff by said grill means in response to said second output voltage.

2. A combined microwave oven and grill oven comprising:

a heating chamber in which foodstuff is heated;

a microwave source and a grill heater for heating foodstuff in said chamber;

a passageway for air exiting said chamber;

a gas sensor and a heat sensitive element within said passageway for sensing conditions in said chamber and for providing output signals indicative of such conditions;

an enabling circuit for said microwave source;

a sole cooking switch for activating said combined oven for cooking a plurality of kinds of foodstuff;

a microcomputer including memory means for storing programs related to various kinds of foodstuff, means for receiving output signals from said gas sensor and for identifying the type of foodstuff being heated in said chamber in response to variations in said output signals from said gas sensor and to said stored programs, and means for establishing a first final signal level and for generating a stop signal for said enabling circuit when said output signal from said gas sensor reaches said first final signal level;

said microcomputer further comprising means for establishing a second final signal level and for determining the length of time during which said grill heater is actuated for heating the foodstuff in response to variations in said output signal from said heat sensitive element, and means for terminating operation of said grill heater when said output signal from said heat sensitive element reaches said second final signal level.

3. The combined oven of claim 2, comprising compensation means for varying the length of time said grill heater is actuated.

* * * * *